US008146604B2

(12) United States Patent
Wright et al.

(10) Patent No.: US 8,146,604 B2
(45) Date of Patent: Apr. 3, 2012

(54) FLUID DELIVERY DEVICE

(75) Inventors: Clifford Wright, San Diego, CA (US); Richard Ouellette, Poway, CA (US)

(73) Assignee: Angles Beauty, Poway, CA (US)

( * ) Notice: Subject to any disclaimer, the term of this patent is extended or adjusted under 35 U.S.C. 154(b) by 695 days.

(21) Appl. No.: 12/152,667

(22) Filed: May 14, 2008

(65) Prior Publication Data

US 2008/0308117 A1 Dec. 18, 2008

Related U.S. Application Data

(60) Provisional application No. 60/930,258, filed on May 14, 2007.

(51) Int. Cl.
*A45D 24/22* (2006.01)

(52) U.S. Cl. ..... 132/112

(58) Field of Classification Search ..... 132/112–116; 222/95, 105, 386.5, 387, 389
See application file for complete search history.

(56) References Cited

U.S. PATENT DOCUMENTS

| | | | | |
|---|---|---|---|---|
| 2,603,223 | A | 7/1952 | Jefferson | |
| 2,774,095 | A | 12/1956 | Berg | |
| 2,895,486 | A | 7/1959 | Sayer | |
| 3,368,569 | A * | 2/1968 | Lawrence | 132/116 |
| 3,429,642 | A | 2/1969 | Underwood | |
| 3,921,858 | A * | 11/1975 | Bemm | 222/146.5 |
| 4,309,119 | A | 1/1982 | Wittersheim | |
| 4,552,477 | A | 11/1985 | Braithwaite et al. | |
| 4,597,683 | A | 7/1986 | Wittersheim et al. | |
| 5,024,243 | A | 6/1991 | Snyder | |
| 5,152,305 | A * | 10/1992 | Niv | 132/112 |
| 5,184,757 | A * | 2/1993 | Giannuzzi | 222/82 |
| 5,289,833 | A | 3/1994 | McDonald | |
| 5,333,627 | A | 8/1994 | Mehringer et al. | |
| 5,339,839 | A | 8/1994 | Forcelledo et al. | |
| 5,927,290 | A | 7/1999 | Thiruppathi | |
| 6,000,405 | A | 12/1999 | De Laforcade | |
| 6,022,163 | A * | 2/2000 | Asfur | 401/175 |
| 6,357,449 | B1 * | 3/2002 | Chu et al. | 132/112 |
| 6,367,483 | B1 | 4/2002 | Chen et al. | |
| 6,513,534 | B1 | 2/2003 | Sofer et al. | |
| D485,642 | S | 1/2004 | Walz | |
| 6,691,712 | B2 | 2/2004 | Chu et al. | |
| 7,011,468 | B1 | 3/2006 | Leventhal | |
| 7,044,137 | B2 | 5/2006 | Glucksman | |
| 7,055,528 | B2 | 6/2006 | Shah et al. | |
| 7,156,104 | B2 | 1/2007 | Kennedy et al. | |

(Continued)

FOREIGN PATENT DOCUMENTS

DE 2845557 4/1980

(Continued)

*Primary Examiner* — Rachel Steitz
(74) *Attorney, Agent, or Firm* — Fred D. Hernandez; Mintz, Levin, Cohn, Ferris, Glovsky and Popeo, P.C.

(57) ABSTRACT

A fluid delivery device includes an accumulator, a deformable fluid reservoir, a user-actuated valve, a fluid delivery channel and an application element. The accumulator accumulates pressure and houses the fluid reservoir. The fluid delivery channel couples the fluid reservoir on a proximal end and extends to a distal end. A user-actuated valve controls a flow rate of fluid passing through the fluid delivery channel from the fluid reservoir to the distal end in response to pressure in the accumulator being above a predetermined threshold. The application element is coupled to the distal end of the fluid delivery channel to facilitate dispersal of fluid from the fluid delivery channel.

15 Claims, 8 Drawing Sheets

U.S. PATENT DOCUMENTS

| | | | |
|---|---|---|---|
| 2004/0221864 | A1 | 11/2004 | Capristo |
| 2005/0109359 | A1 | 5/2005 | Carballada et al. |
| 2006/0021627 | A1 | 2/2006 | Lee |

FOREIGN PATENT DOCUMENTS

| | | |
|---|---|---|
| GB | 2370264 | 6/2002 |
| WO | WO 98/51183 | 11/1998 |

* cited by examiner

FLUID DELIVERY DEVICE

REFERENCE TO PRIORITY DOCUMENT

This application claims priority of U.S. Provisional Patent Application Ser. No. 60/930,258, filed May 14, 2007. Priority of the aforementioned filing date is hereby claimed and the disclosure of the Provisional Patent Application is hereby incorporated by reference in its entirety.

TECHNICAL FIELD

The subject matter described herein relates to a fluid delivery device, and in particular, to a hair dye application device.

BACKGROUND

Conventional techniques for applying hair color involve the application of liquid hair dye using brushes moistened with the dye. Such arrangements are imprecise in nature and often result in spillage of droplets of dye.

SUMMARY

In one aspect, a hair dye application apparatus includes a deformable fluid reservoir housing hair dye, a pressure inducing element (e.g., pressure accumulator, mechanical actuator, pressure source, etc.) to apply a positive pressure to the fluid reservoir, an application element (e.g., brush, etc.) to disperse the dye into hair, and a fluid delivery channel to deliver dye from the fluid reservoir to the application element in response to the positive pressure being applied to the fluid reservoir.

The pressure inducing element can comprise a pressure accumulator that can be pressurized either from an internal pressure source or an external pressure source (e.g., compressor, hand pump, etc.). If an external pressure source is utilized, then the pressure inducing element can also include a port that can be either permanently or detachably coupled to the external pressure source. The external pressure source, in some variations, is a pressurized cartridge and so the apparatus includes a fitting for receiving the pressurized cartridge. This fitting can include pressure release ports to ensure that the pressurized cartridge can be safely removed.

The apparatus can also include an actuation valve (which a user may depress) that is disposed between the fluid reservoir and the application element to selectively control a flow rate of dye to the application element.

The fluid reservoir may be made of any material that is flexible so that upon the application of pressure, fluid contained therein can be expelled. In some variations, the fluid reservoir is a plastic pouch.

In an interrelated aspect, an apparatus includes an accumulator to accumulate pressure, a deformable fluid reservoir disposed within the accumulator, a fluid delivery channel coupled to the fluid reservoir on a proximal end and extending to a distal end, a user-actuated valve to control a flow rate of fluid passing through the fluid delivery channel from the fluid reservoir to the distal end in response to pressure in the accumulator being above a predetermined threshold, and an application element coupled to the distal end of the fluid delivery channel for dispersing fluid from the fluid delivery channel.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

Like reference symbols in the various drawings indicate like elements.

DETAILED DESCRIPTION

Figure 1:
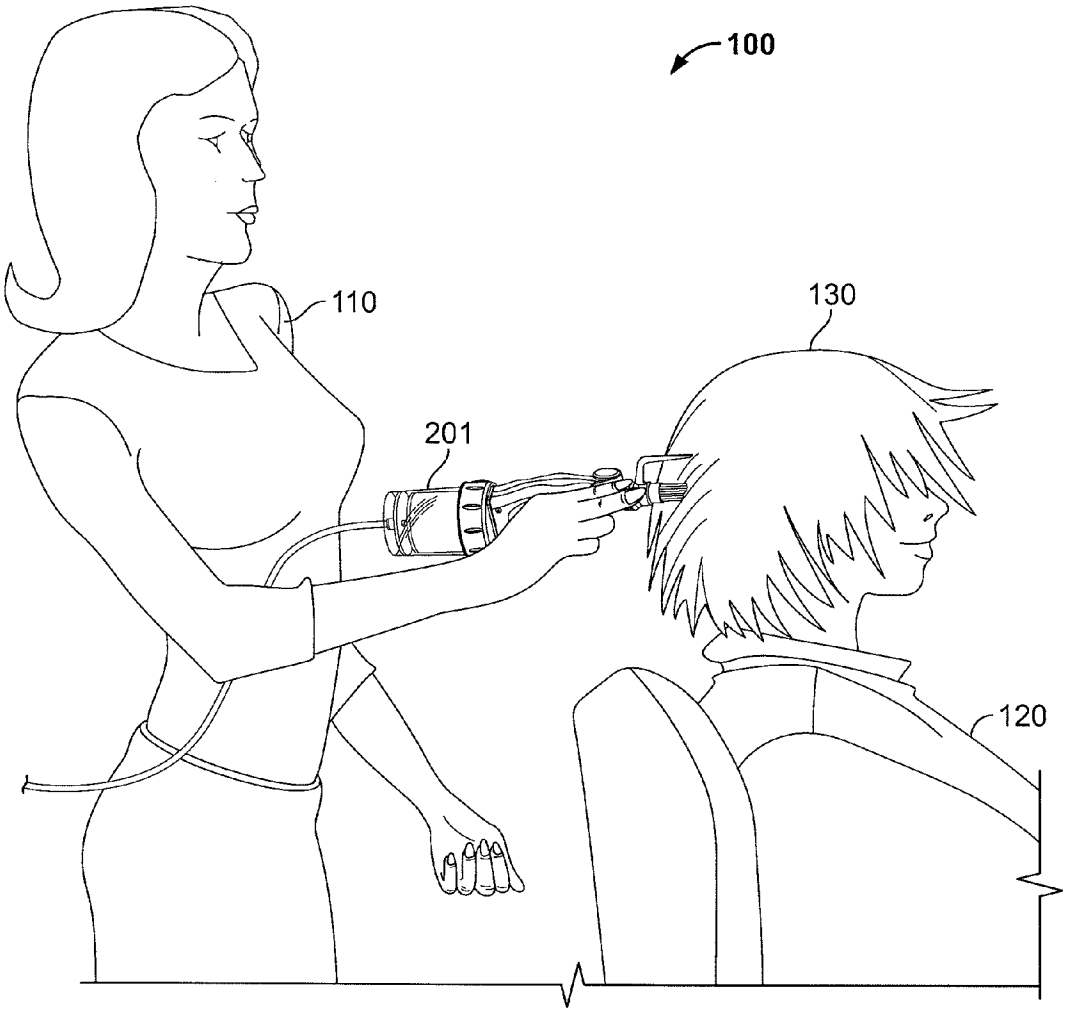
FIG. 1 is a diagram illustrating a first person using a fluid delivery device on a second person.

FIG. 1 is a diagram 100 illustrating a stylist 110 applying dye to the hair 130 of a consumer 120 using a color wand 201. While the following description relates to the application of hair dye, it will be appreciated that the fluid delivery devices described herein may be used in other applications in which it is desirable to selectively apply a liquid to a surface including other hair products or skin treatments (e.g., facials, chemical peels, etc.) and the like.

Figure 2:
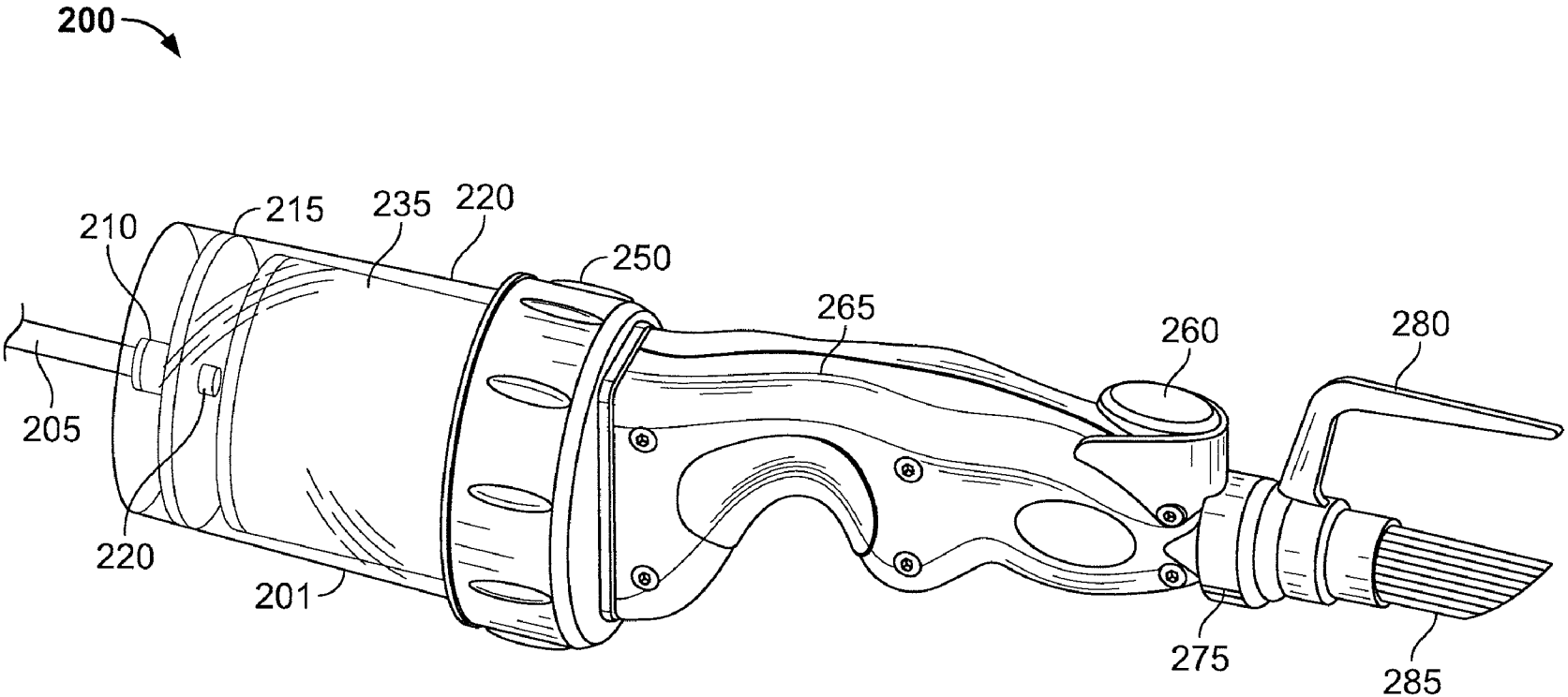
FIG. 2 is a side view of a first variation of a fluid delivery device in which pressure is supplied by an external source.
Figure 3:
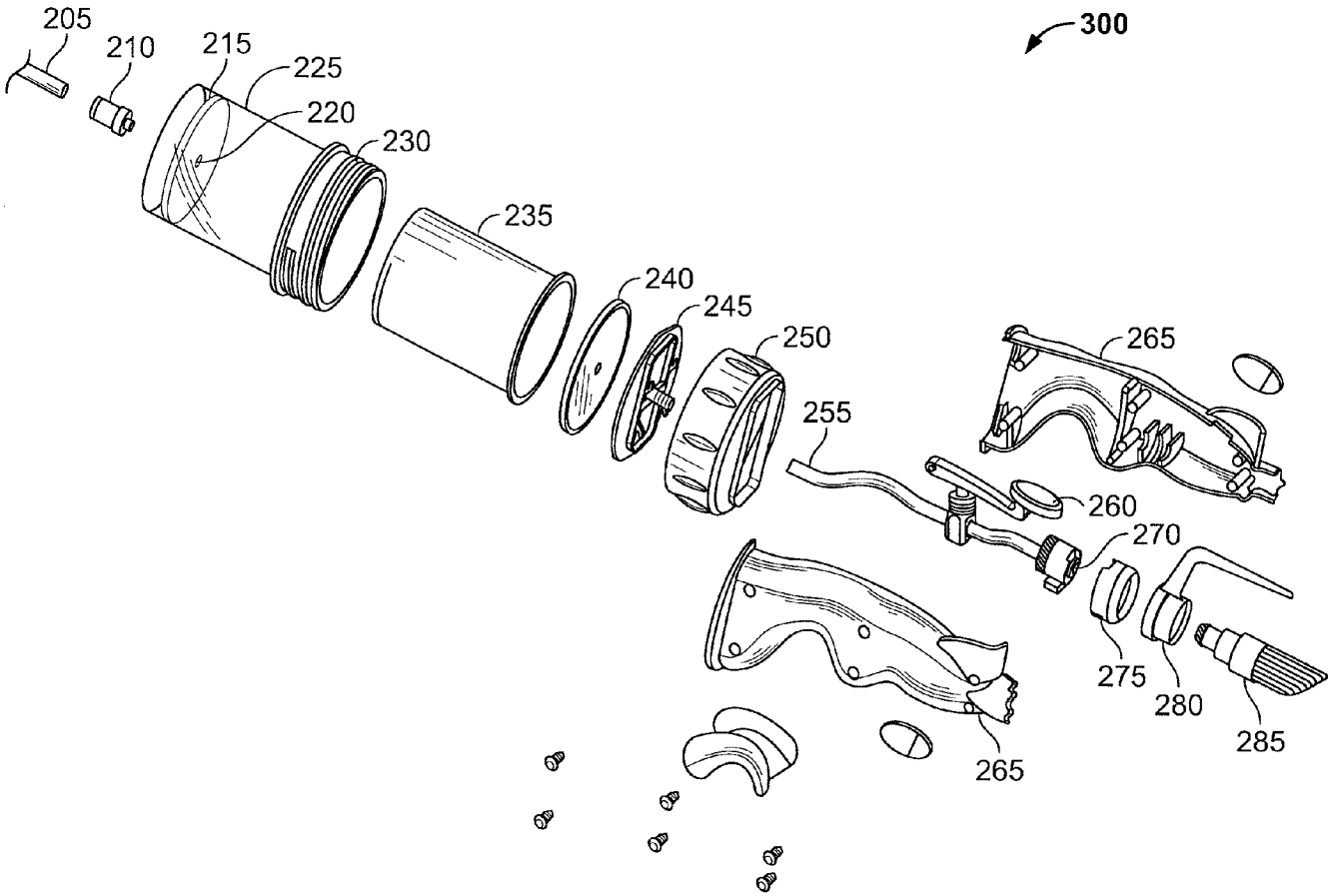
FIG. 3 is an exploded view of the first variation of the fluid delivery device.
Figure 4:
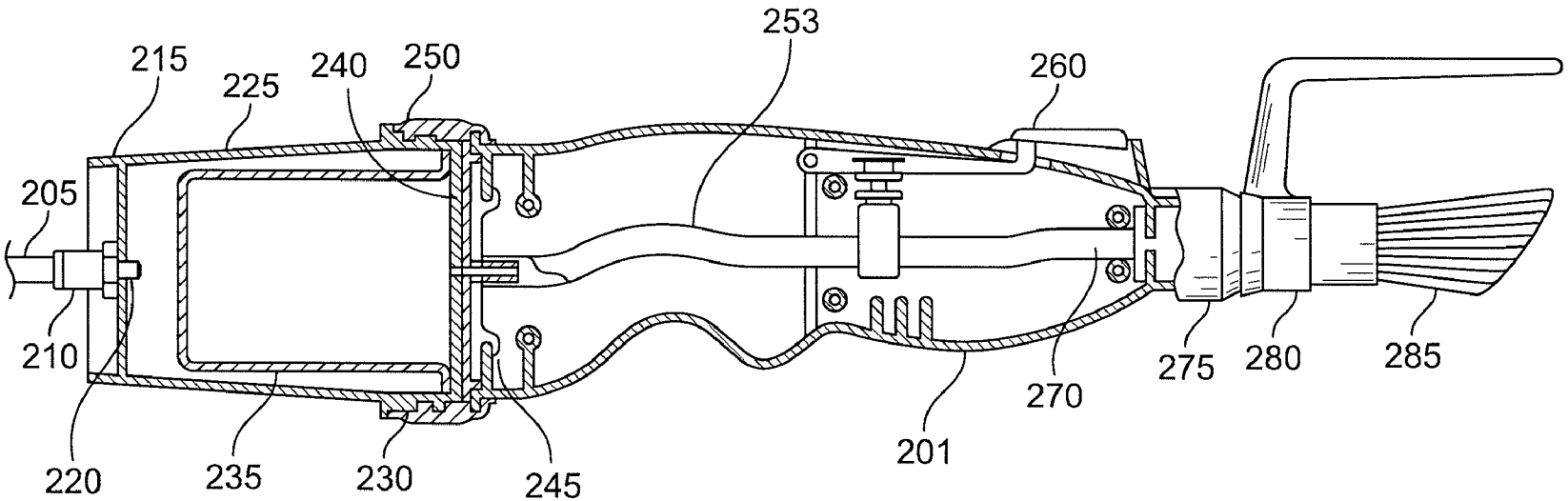
FIG. 4 is cross-sectional view of the first variation of the fluid delivery device.

The following makes reference to FIG. 2 which is a schematic diagram 200 of one variation of the color wand 201, FIG. 3 which is an exploded view 300 of the variation of the color wand 201, and FIG. 4 which is a cross-sectional view 400 of the variation of the color wand 201. The color wand 201 may include a housing 202 having an accumulator 225 on a proximal end and a dispensation outlet 270 on a distal end. In some implementations, the accumulator 225 may include a sealing member 215 with a pressurization inlet 220 that is connected to a coupler 210 which in turn is coupled to a tube 205 connected to an external pressure source (e.g., a compressor, etc.). When assembled, the accumulator 225 houses a deformable fluid reservoir 235 which houses a liquid such as hair dye. The fluid reservoir 235 may be, for example, a plastic pouch that can be pierced to create an orifice for fluid flow.

A securing member 250 is configured to receive threads 230 on the accumulator 225 to secure the fluid reservoir 235 within the accumulator 225 as well as a diaphragm 240 which acts to regulate fluid flow passing therebetween and a mounting member 245. The mounting member 245 can be detachably coupled to a delivery channel 255 on a proximal end. The mounting member 245 may include a male extension that is operable to fit within a female orifice on the proximal end of the delivery channel 255. The mounting member 245 may also include coupling elements to connect to the fluid reservoir 235, and in some implementations, a piercing element to cause the fluid reservoir 235 to initiate fluid flow (for example, when the fluid reservoir 235 is a pouch). A distal end of the delivery channel 255 terminates at the dispensation outlet 270.

Intermediate the proximal end and the dispensation outlet 270 of the delivery channel 255 is a user actuated valve 260 which can selectively reduce (or completely turn off) the rate of fluid flow through the delivery channel 260. Attached outside the delivery channel 255 is a grip portion 265 which a user can grasp onto and that can extend approximately from the securing member 250 to approximately the dispensation outlet 270. A securing ring 275 can be used to couple a guide 280 to facilitate usage of the color wand 201 and an application member 285 (e.g., bristles or a hair brush). The application member 285 can be used to ensure uniform and/or selective application of the liquid onto the desired surface and can include a plurality of outlets to increase a surface area to which the hair dye is applied. The guide 280 can also be used to provide a visual estimation of the surface to which liquid is being applied and/or to remove obstructions (e.g., hair, etc.) to the dispensation outlet 270.

When activated, pressure is introduced into the accumulator 225 via the pressurization inlet 220 so that the liquid reservoir 235 is biased inward. This in turn causes liquid within the liquid reservoir 235 to pass through the diaphragm 245 into the delivery channel 255 and out the dispensation outlet 270 (assuming that the valve 260 is open (or at least not completely closed)) and through the application member 285 into the hair 130 of the consumer 120.

Figure 5:
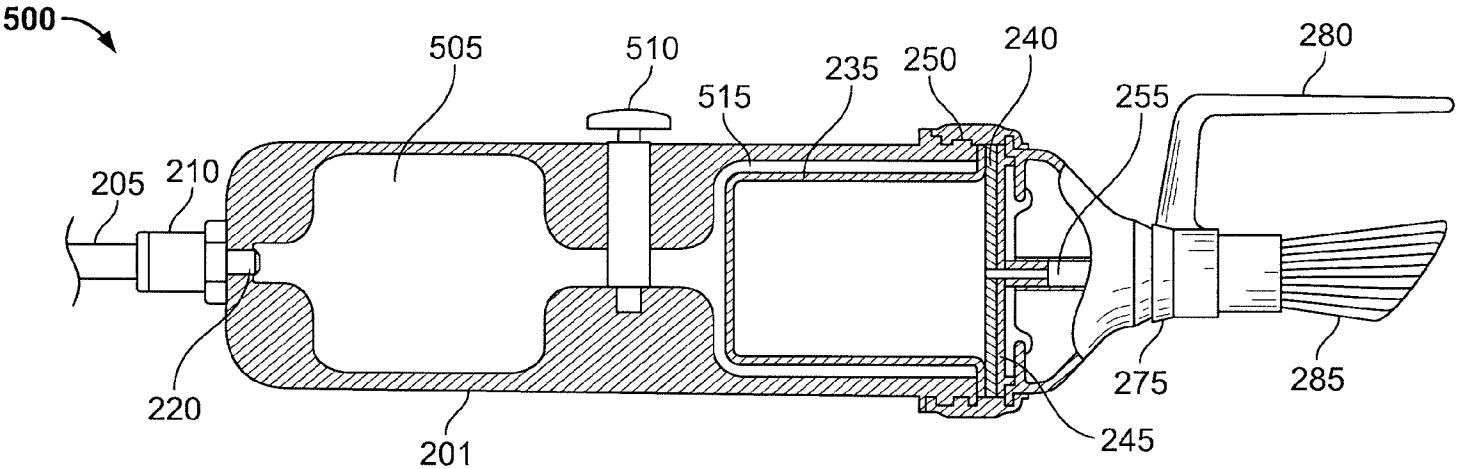
FIG. 5 is a cross-sectional view of a second variation of the fluid delivery device that contains a pressurization chamber.

FIG. 5 is a cross-sectional view 500 of a variation of the color wand 201 in which the accumulator 225 omits the sealing member 215 but includes a pressurization chamber 505 separated from a reservoir chamber 515 housing the liquid reservoir 235 by a user-actuated valve 510 that also acts to limit the pressure within the reservoir chamber 515. With such an implementation, the pressurization chamber 505 may be pressurized via a pressurization inlet 220 from either an attached external pressure source (via, for example, the tube 205), or from a detachable external pressure source. If a detachable external pressure source is utilized, the tube 205 or other pressure delivery conduit may remain attached to the pressure source but detached from the color wand 201 so that the color wand 201 may be more easily used by the stylist 110.

Figure 6:
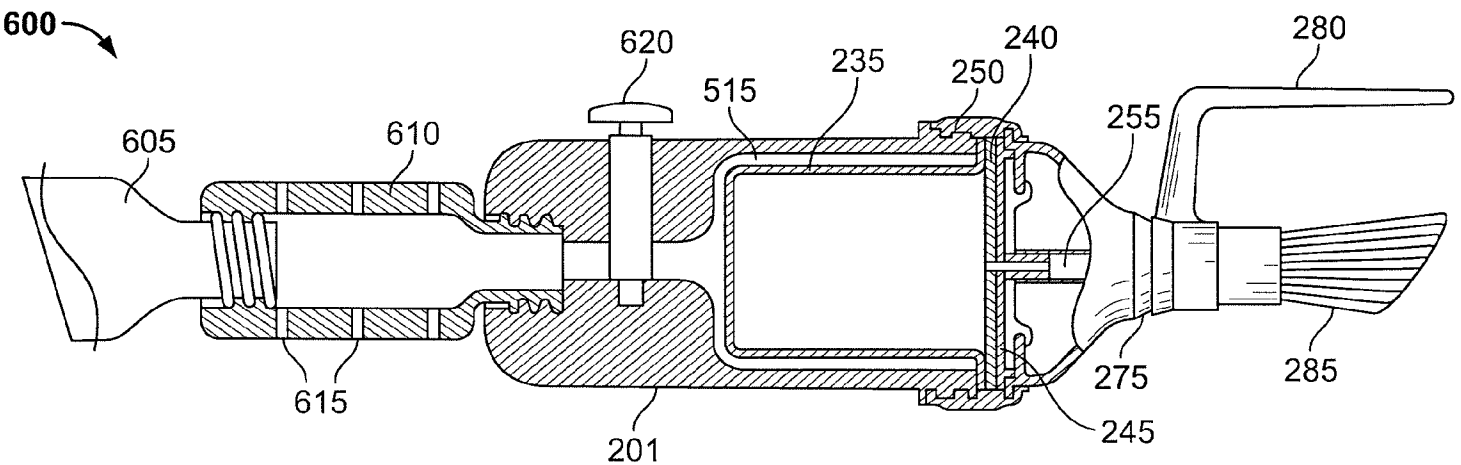
FIG. 6 is a cross-sectional view of a third variation of the fluid delivery device that is pressurized by a cartridge.
Figure 7:
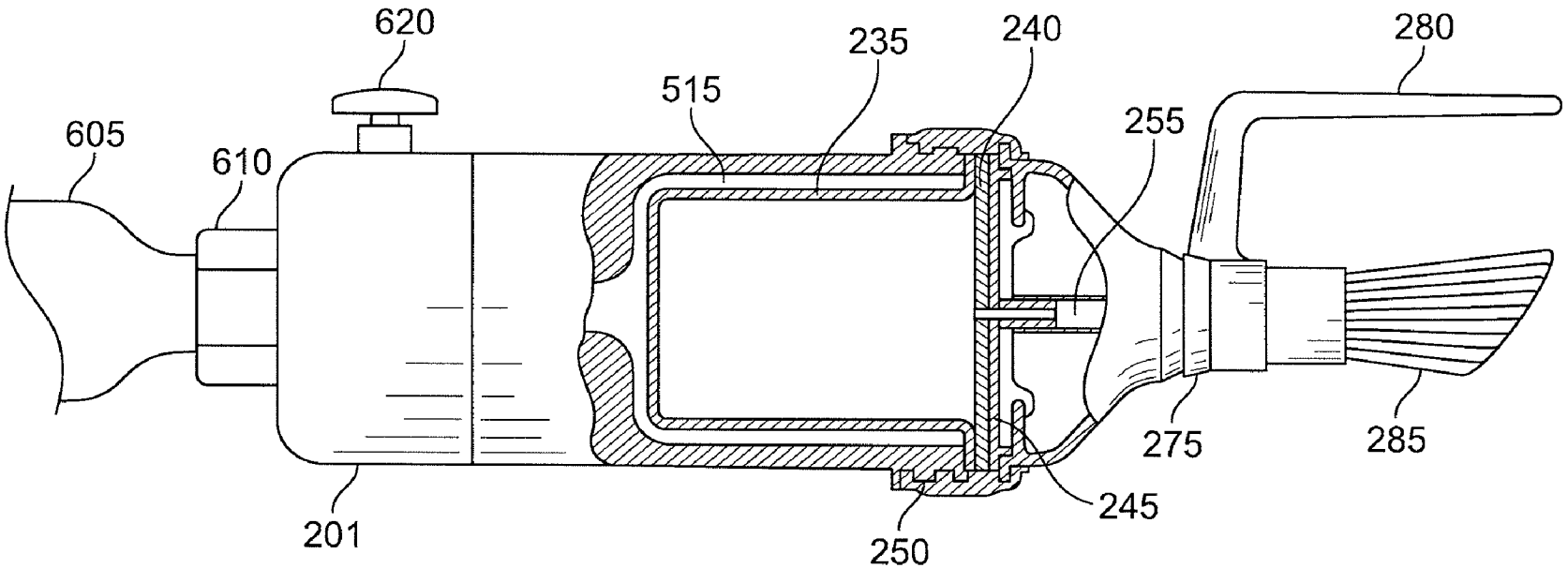
FIG. 7 is a cut-away view of the third variation of the fluid delivery device.

FIG. 6 is a cross sectional view 600 of yet another variation of the color wand 201 in which the pressurization chamber 505 of FIG. 5 is replaced with a cartridge adapter 610 that is configured to receive a pressurized cartridge 605 (e.g., $CO_2$ cartridge, etc.) that can be activated when advanced into the cartridge adapter 610. The cartridge adapter 610 can also include one or more ports 615 that act to release pressure if it exceeds a predetermined amount when the cartridge 605 is being removed (to avoid, for example, an inadvertent expulsion of the cartridge 605 thereby injuring the stylist 110 or the consumer 120). A user-actuated valve 620 may also be configured with a flow limiter to limit the pressure within the reservoir chamber 515. FIG. 7 is a partial cross-sectional view 700 of the color wand 201 illustrated in FIG. 6.

Figure 8:
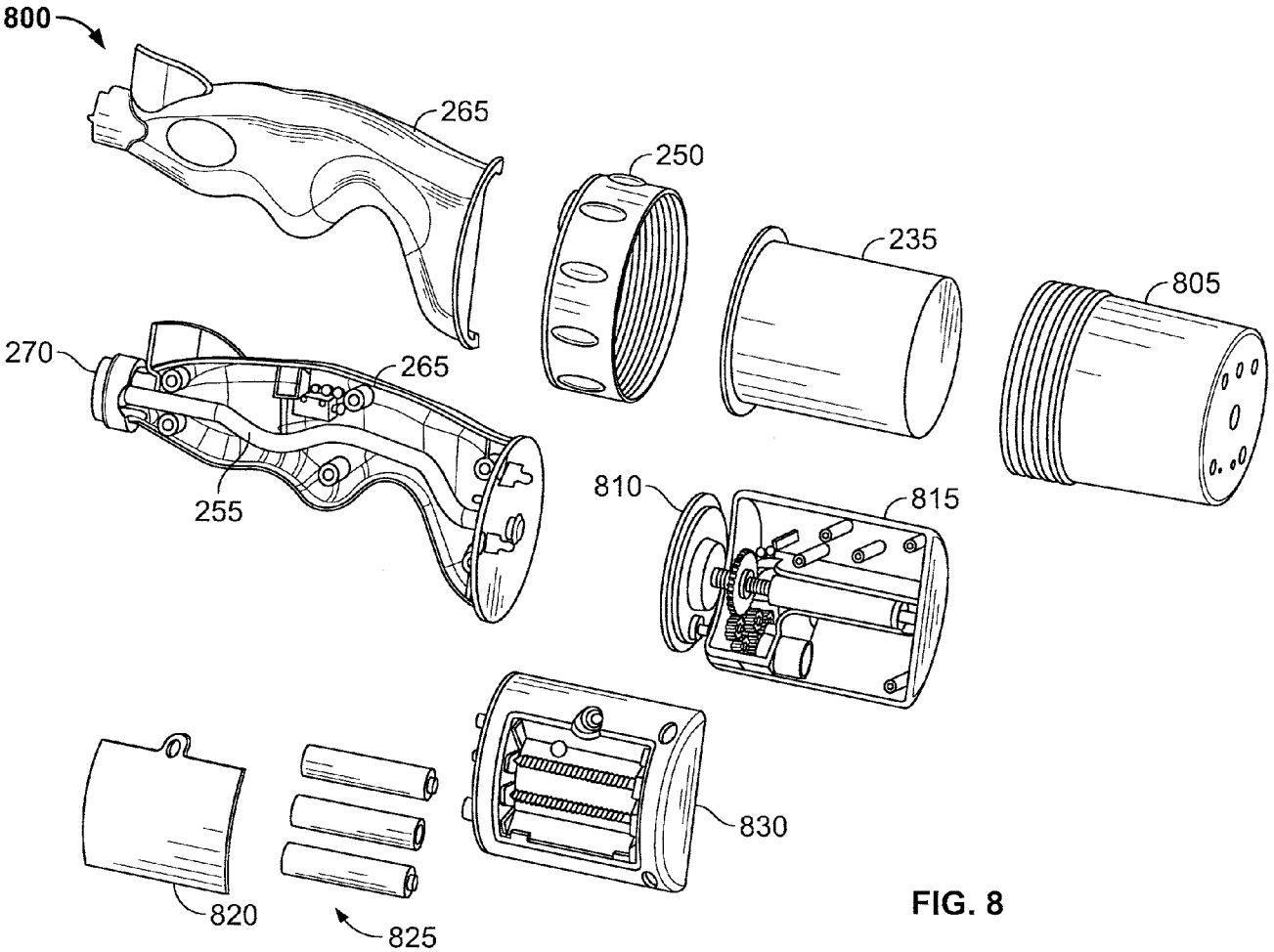
FIG. 8 is an exploded view of a fourth variation of the fluid delivery device that includes a mechanical actuator to facilitate fluid flow.

FIG. 8 is an exploded view 800 of still another variation of the color wand 201 that includes a mechanical pressure inducing element. In particular, this variation includes a liquid reservoir housing 805 adapted to receive the liquid reservoir 235 and to be coupled to a mechanical actuator 815. The mechanical actuator 815 includes a plunging member 810, which is operable to be fitted within the liquid reservoir housing 805 and extendable to apply pressure to the liquid reservoir 235 (which results in liquid passing through the delivery channel 255 when it is not obstructed). The mechanical actuator 815 can be battery-powered and include a battery casing 830 with lid 820 into which batteries 825 may be inserted.

Figure 9:
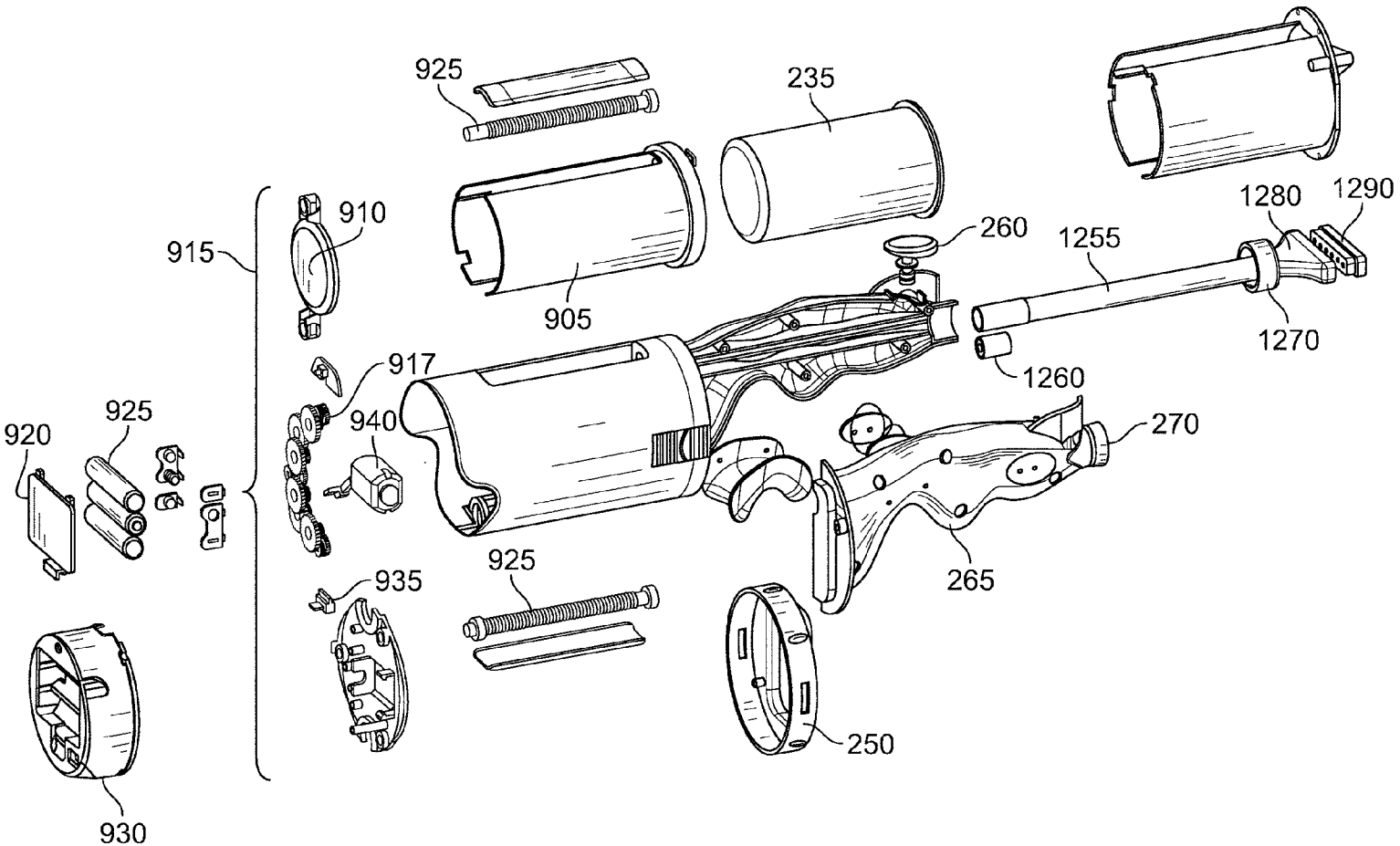
FIG. 9 is an exploded view of a fifth variation of the fluid delivery device.

FIG. 9 is an exploded view 900 of another variation of the color wand 201 that includes a motorized mechanical pressure inducing element. In particular, this variation includes a liquid reservoir housing 905 adapted to receive the liquid reservoir 235 and to be coupled to a mechanical actuator 915. The mechanical actuator 915 includes a plunging member 910, which is operable to be fitted within the liquid reservoir housing 905 and extendable to apply pressure to the liquid reservoir 235. The mechanical actuator 915 includes an on/off switch 935 that actuates a motor 940 that turns a gear assembly causing the plunging member 910 to apply pressure to the liquid reservoir 235. The gear assembly can include a gear 927, such as an ear crown gear, that is turned by one or more worm gears 925. The motorized mechanical actuator 915 can also be battery-powered and, for example include a battery casing 930 with lid 920 into which batteries 925 may be inserted. The mechanical actuator 915 can also include a rechargeable battery casing 930.

The embodiment in FIG. 9 also shows a delivery channel 1255 that detachably couples at its proximal end to a mounting member (not shown). The proximal end of the delivery channel 1255 includes a valve 1260 residing inside the shaft. The valve 1260 can be a one-way valve, such as a poppet valve or valve stem, and prevents the flow of liquid back into the fluid reservoir 235. The distal end of the delivery channel 1255 terminates at an adjustable dispensation outlet 1270. The outlet 1270 has adjustable orifice sizes that control the rate of fluid flow through the delivery channel outlet 1280 to the application member (not shown). Also shown is a cushioning member 1290 that can be inserted between an application member and the delivery channel outlet 1280.

Although a few variations have been described in detail above, other modifications are possible. For example, certain components of the color wand may be integrated or comprised of multiple sub-parts depending on the desired configuration. In some implementations, the fluid delivery channel and the brush are integrated and disposable. Other embodiments may be within the scope of the following claims.

What is claimed is:

1. A hair dye application apparatus comprising:

a deformable fluid reservoir to house hair dye;

a pressure inducing element to apply a positive pressure to the fluid reservoir;

an application element to disperse the dye into hair, wherein the application element is a brush having a distal tip;

a securing ring that attaches the application element to the apparatus;

a guide member comprising an L-shaped, elongated element having a proximal end attached to the securing ring and a distal end the L-shaped element of the guide member extends along an outer surface of the brush, and, wherein the distal end of the guide member extends to a distal location adjacent the distal tip of the brush; and a fluid delivery channel to deliver dye from the fluid reservoir to the application element in response to the positive pressure applied to the fluid reservoir.

2. An apparatus as in claim 1, wherein the pressure inducing element comprises a port coupled to an external pressure source.

3. An apparatus as in claim 2, wherein the external pressure source is a pressurized cartridge.

4. An apparatus as in claim 1, wherein the pressure inducing element comprises an internal pressure source.

5. An apparatus as in claim 4, wherein the internal pressure source is an actuator to apply a mechanical force to the fluid reservoir.

6. An apparatus as in claim 5, wherein the actuator is a plunger.

7. An apparatus as in claim 5, wherein the actuator is motorized.

8. An apparatus as in claim 5, wherein the actuator includes at least one gear.

9. An apparatus as in claim 8, wherein the at least one gear includes a worm gear.

10. An apparatus as in claim 1, further comprising a grip portion disposed between the fluid reservoir and the application element.

11. An apparatus as in claim 1, further comprising a valve disposed between the fluid reservoir and the application element to selectively control a flow rate of dye to the application element.

12. An apparatus as in claim 11, further comprising a valve disposed within the fluid delivery channel between the fluid reservoir and the actuation valve, the control valve adapted to control direction of dye flow through the apparatus.

13. An apparatus as in claim 11, further comprising an element disposed between the fluid delivery channel and the application element to selectively control a flow rate of dye to the application element.

14. An apparatus as in claim 1, wherein the fluid reservoir is a pouch.

15. An apparatus as in claim 12, wherein the valve is a one-way valve that allows fluid flow toward the application element and prevents fluid flow of dye into the fluid reservoir.

* * * * *